US007172662B2

(12) United States Patent
Usami et al.

(10) Patent No.: US 7,172,662 B2
(45) Date of Patent: Feb. 6, 2007

(54) COPPER ALLOY MATERIAL FOR PARTS OF ELECTRONIC AND ELECTRIC MACHINERY AND TOOLS

(75) Inventors: Takayuki Usami, Tokyo (JP); Takao Hirai, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 58 days.

(21) Appl. No.: 10/354,151

(22) Filed: Jan. 30, 2003

(65) Prior Publication Data

US 2003/0165708 A1 Sep. 4, 2003

Related U.S. Application Data

(63) Continuation-in-part of application No. 10/005,880, filed on Nov. 2, 2001, which is a continuation of application No. PCT/JP01/04351, filed on May 24, 2001.

(30) Foreign Application Priority Data

Jul. 25, 2000 (JP) ..... 2000-224425

(51) Int. Cl.
*C22C 9/06* (2006.01)

(52) U.S. Cl. ..... 148/433; 420/476

(58) Field of Classification Search ..... 148/433; 420/476

See application file for complete search history.

(56) References Cited

U.S. PATENT DOCUMENTS

| | | | | |
|---|---|---|---|---|
| 4,362,579 | A | 12/1982 | Tsuji | |
| 4,594,221 | A | 6/1986 | Caron et al. | 420/485 |
| 4,612,167 | A | 9/1986 | Watanabe et al. | 420/471 |
| 4,656,003 | A | 4/1987 | Miyafuji et al. | 420/473 |
| 4,687,633 | A | 8/1987 | Miyafuji et al. | 420/481 |
| 4,728,372 | A | 3/1988 | Caron et al. | 148/2 |
| 4,877,577 | A | 10/1989 | Futatsuka et al. | |
| 5,028,391 | A | 7/1991 | Ingerson | |

(Continued)

FOREIGN PATENT DOCUMENTS

| | | |
|---|---|---|
| EP | 0 440 548 | 8/1991 |

(Continued)

OTHER PUBLICATIONS

Journal of the Japan Copper and Brass Research Association, 2001, vol. 40, w/concise explanation thereof.

(Continued)

*Primary Examiner*—Sikyin Ip
(74) *Attorney, Agent, or Firm*—Westerman, Hattori, Daniels & Adrian, LLP

(57) ABSTRACT

A copper alloy material for parts of electronic and electric machinery and tools contains 1.0 to 3.0 mass % of Ni, 0.2 to 0.7 mass % of Si, 0.01 to 0.2 mass of Mg, 0.05 to 1.5 mass % of Sn, 0.2 to 1.5 mass % of Zn, and less than 0.005 mass % (including 0 mass %) of S, with the balance being Cu and inevitable impurities, wherein the copper alloy material has:
(1) a specific crystal grain diameter, and a specific ratio between the longer diameters of a crystal grain on a cross section parallel or perpendicular to a direction of final plastic working; and/or
(2) a specific surface roughness after the final plastic working.

8 Claims, 1 Drawing Sheet

U.S. PATENT DOCUMENTS

| | | | | |
|---|---|---|---|---|
| 5,334,346 | A | 8/1994 | Kim et al. | |
| 5,463,247 | A | 10/1995 | Futatsuka et al. | |
| 5,508,001 | A | 4/1996 | Suzuki et al. | |
| 5,675,883 | A | 10/1997 | Gaag et al. | |
| 5,833,920 | A | 11/1998 | Nakanishi et al. | 420/477 |
| 5,846,346 | A | 12/1998 | Lee et al. | 148/433 |
| 5,997,810 | A | 12/1999 | Futatsuka et al. | |
| 6,040,067 | A | 3/2000 | Sugawara et al. | 428/647 |
| 2002/0119071 | A1 | 8/2002 | Usami et al. | |
| 2002/0127133 | A1 | 9/2002 | Usami et al. | |

FOREIGN PATENT DOCUMENTS

| | | |
|---|---|---|
| EP | 0 501 438 | 9/1992 |
| EP | 0 949 343 | 10/1999 |
| JP | 59-193233 | 11/1984 |
| JP | 61-127842 | 6/1986 |
| JP | 63-130739 | 6/1988 |
| JP | 01-180932 | 7/1989 |
| JP | 2-118037 | 5/1990 |
| JP | 2-170937 | 7/1990 |
| JP | 3-188247 | 8/1991 |
| JP | 5-1367 | 1/1993 |
| JP | 5-59468 | 3/1993 |
| JP | 5-311278 | 11/1993 |
| JP | 5-345941 | 12/1993 |
| JP | 6-41660 | 2/1994 |
| JP | 06-100983 | 4/1994 |
| JP | 07-054079 | 2/1995 |
| JP | 7-90520 | 4/1995 |
| JP | 10-330867 | 12/1998 |
| JP | 11-043731 | 2/1999 |
| JP | 1-140569 | 5/1999 |
| JP | 11-222641 | 8/1999 |
| JP | 11-256256 | 9/1999 |
| JP | 2002-38228 | 2/2002 |
| JP | 2002-180161 | 6/2002 |
| JP | 2002-339029 | 11/2002 |
| JP | 3094045 | 3/2003 |
| TW | 448235 | 8/2001 |

OTHER PUBLICATIONS

Furukawa Electric Review, No. 107, Jan. 2001, w/concise explanation thereof.

Synopses of the 38th Symposium of Copper and Brass Technical Research Association, published on Sep. 22, 1998, w/English translation.

Synopsses of the 40th Symposium of Copper and Brass Technical Research Association, published on Sep. 20, 2000, w/English translation.

33rd Annual IICIT, 2000 Conference Proceeding of Oct. 23, 2000.

Japanese Office Action (Decision of Rejection) mailed Jan. 10, 2006 issued in corresponding Japanese Application No. 2001-148521.

Basic and Industrial Technique of Copper and Copper Alloy (Revised Edition); Japan Copper and Brass Association; 1988, 1994(revised); pp. 340-343, 475-476, 484-482 and 345(revised), Concise Explanation.

COPPER ALLOY MATERIAL FOR PARTS OF ELECTRONIC AND ELECTRIC MACHINERY AND TOOLS

This is a continuation-in-part application of U.S. patent application Ser. No. 10/005,880, filed on Nov. 2, 2001, which is a continuation of PCT Application No. PCT/JP01/04351, filed on May 24, 2001. The prior PCT application was not published in English under PCT Article 21(2).

TECHNICAL FIELD

The present invention relates to a copper alloy material for parts of electronic and electric machinery and tools, in particular to the copper alloy material for parts of electronic and electric machinery and tools, which is excellent in bending property and stress relaxation property, and which can sufficiently cope with miniaturization of parts of electronic and electric machinery and tools, such as terminals, connectors, switches and relays.

BACKGROUND ART

Hitherto, copper alloys, such as Cu—Zn alloys, Cu—Fe alloys that are excellent in heat resistance, and Cu—Sn alloys, have been frequently used for parts of electronic and electric machinery and tools. While inexpensive Cu—Zn alloys have been used frequently, for example, in automobiles, the Cu—Zn alloys as well as Cu—Fe alloys and Cu—Sn alloys have been unable to currently cope with the requirements for use to automobiles, since recent trends strongly require to make the size of terminals and connectors to be as small as possible, and they are mostly used under severe conditions (at a high temperature and under corrosive environments) in an engine room and the like.

In accordance with the changes of working conditions, severe characteristics are required for the terminal and connector materials. While copper alloys that are used in these application fields are required to have various characteristics, such as stress relaxation property, mechanical strength, heat conductivity, bending property, heat resistance, reliable connection to Sn plating, and anti-migration property, particularly important characteristics include mechanical strength, stress relaxation property, heat and electric conductance, and bending property.

The structure of the terminals have been variously devised for ensuring connection strength at the spring parts in relation to miniaturization of the parts. As a result, the materials are more strictly required to be excellent in bending property, since cracks have been often observed at the bent portion in conventional Cu—Ni—Si alloys. The materials are also required to be excellent in stress relaxation property, and the conventional Cu—Ni—Si alloys cannot be used for a long period of time, due to increased stress load on the material and high temperatures in the working environments.

It is indispensable to improve bending property when the alloy materials are used for the automobile connectors. Although improvements of bending property have been investigated in ways, it has been difficult to improve the bending property while maintaining the mechanical strength and elasticity.

Conductivity and stress relaxation property should be balanced since stress relaxation is accelerated due to auto-heating when the materials are poor in heat and electric conductivity.

On the other hand, the following requirements have been also addressed, with respect to improvement in compatibility to plating for plating the copper alloy material for parts of electronic and electric machinery and tools, and in resistance to deterioration of plate after plating (which are collectively called as plating characteristics).

Cu plating is generally applied on the material as an underlayer followed by Sn plating on the surface thereof, for improving reliability when copper-based materials are used for the above automobile connector such as a box-type connector. When unevenness (roughness) of the material surface is larger than the thickness of the plating layer, the plating is repelled from convex portions without being plated to make it impossible to uniformly plate. In addition, the interface area between the material and plating layer is increased to readily cause mutual diffusion between Cu and Sn, thereby the plating layer is readily peeled off due to formation of voids and a Cu—Sn compound. Accordingly, the surface of the material should be as smooth as possible.

While Au is generally plated on the Ni underlayer plating in the terminals or connectors for the electronic and electric appliances such as mobile terminal devices and personal computers, deterioration of the plating layer such as peeling of the plating layer as described above is also caused due to roughness of the surface of the material even when the surface is composed of the Au plating layer and the underlayer is composed of the Ni plating layer.

Accordingly, a copper alloy that satisfies the above plating characteristics as well as various characteristics described above, has been desired.

Other and further features and advantages of the invention will appear more fully from the following description, take in connection with the accompanying drawing.

DISCLOSURE OF THE INVENTION

Figure 1:
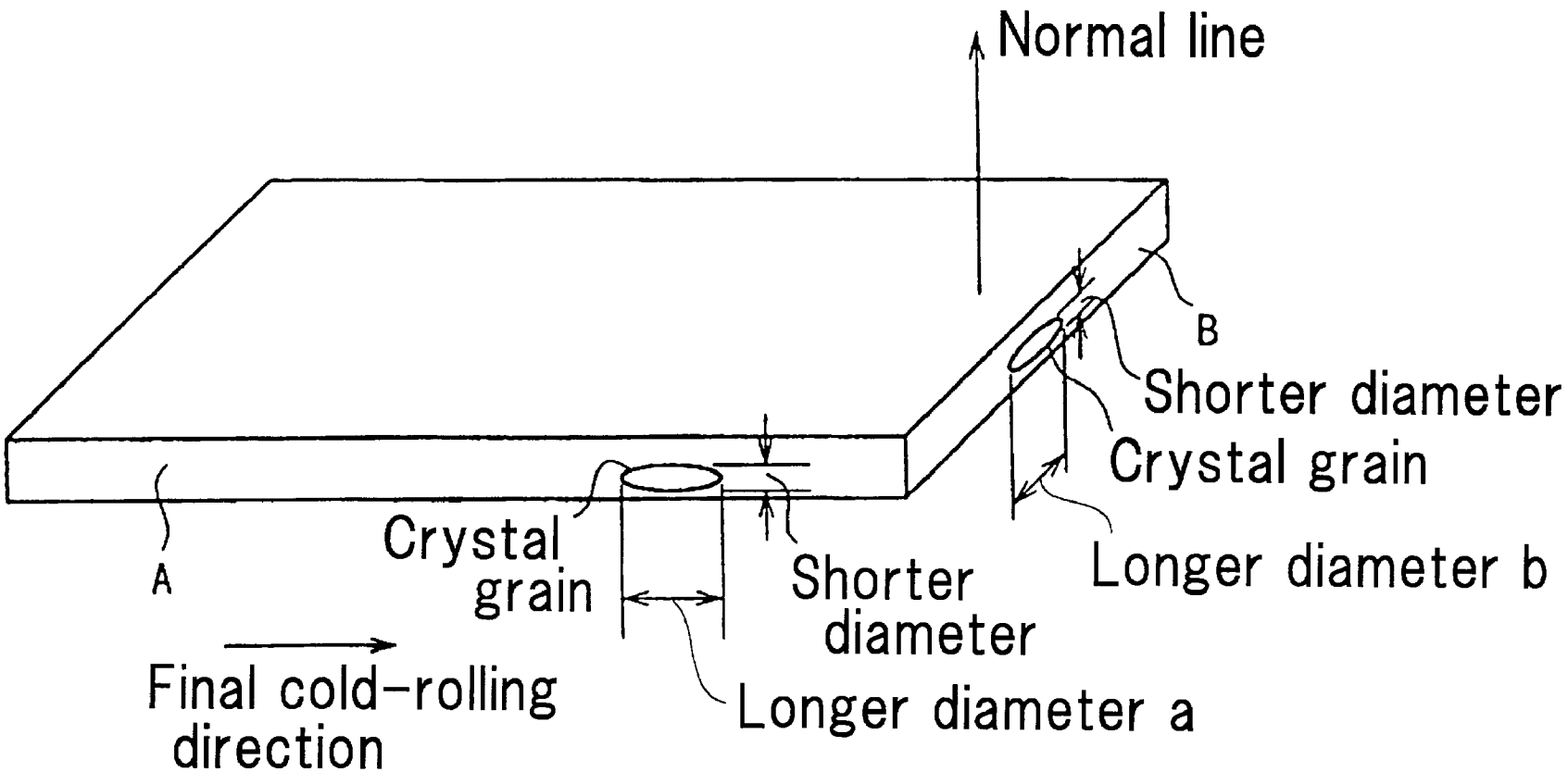
FIG. 1 is an explanatory view on the method for determining the crystal grain diameter and the crystal grain shape, each of which is defined in the present invention.

According to the present invention, there are provided the following means:

(1) A copper alloy material for parts of electronic and electric machinery and tools, comprising 1.0 to 3.0% by mass of Ni, 0.2 to 0.7% by mass of Si, 0.01 to 0.2% by mass of Mg, 0.05 to 1.5% by mass of Sn, 0.2 to 1.5% by mass of Zn, and less than 0.005% by mass (including 0% by mass) of S, with the balance being Cu and inevitable impurities, wherein a crystal grain diameter is more than 0.001 mm and 0.025 mm or less; and the ratio (a/b), between a longer diameter a of a crystal grain on a cross section parallel to a direction of final plastic working, and a longer diameter b of a crystal grain on a cross section perpendicular to the direction of final plastic working, is 1.5 or less.

(2) A copper alloy material for parts of electronic and electric machinery and tools, comprising 1.0 to 3.0% by mass of Ni, 0.2 to 0.7% by mass of Si, 0.01 to 0.2% by mass of Mg, 0.05 to 1.5% by mass of Sn, 0.2 to 1.5% by mass of Zn, 0.005 to 2.0% by mass in a total amount of at least one selected from the group consisting of Ag, Co and Cr (with the proviso that the Cr content is 0.2% by mass or less), and less than 0.005% by mass (including 0% by mass) of S, with the balance being Cu and inevitable impurities, wherein a crystal grain diameter is more than 0.001 mm and 0.025 mm or less; and the ratio (a/b), between a longer diameter a of a crystal grain on a cross section parallel to a direction of final plastic working, and a longer diameter b of a crystal grain on a cross section perpendicular to the direction of final plastic working, is 1.5 or less.

(Hereinafter, the copper alloy materials for parts of electronic and electric machinery and tools described in the above item (1) or (2) are collectively referred to as the first embodiment of the present invention.)

(3) A copper alloy material for parts of electronic and electric machinery and tools, comprising 1.0 to 3.0% by mass of Ni, 0.2 to 0.7% by mass of Si, 0.01 to 0.2% by mass of Mg, 0.05 to 1.5% by mass of Sn, 0.2 to 1.5% by mass of Zn, and less than 0.005% by mass (including 0% by mass) of S, with the balance being Cu and inevitable impurities, wherein a surface roughness Ra after final plastic working is more than 0 μm and less than 0.1 μm, or a surface roughness Rmax is more than 0 μm and less than 2.0 μm.

(4) A copper alloy material for parts of electronic and electric machinery and tools, comprising 1.0 to 3.0% by mass of Ni, 0.2 to 0.7% by mass of Si, 0.01 to 0.2% by mass of Mg, 0.05 to 1.5% by mass of Sn, 0.2 to 1.5% by mass of Zn, 0.005 to 2.0% by mass in a total amount of at least one selected from the group consisting of Ag, Co and Cr (with the proviso that the Cr content is 0.2% by mass or less), and less than 0.005% by mass (including 0% by mass) of S, with the balance being Cu and inevitable impurities, wherein a surface roughness Ra after final plastic working is more than 0 μm and less than 0.1 μm, or a surface roughness Rmax is more than 0 μm and less than 2.0 μm.

(Hereinafter, the copper alloy materials for parts of electronic and electric machinery and tools described in the above item (3) or (4) are collectively referred to as the second embodiment of the present invention. More preferable embodiments with respect to the item (3) or (4) above include the followings.)

(5) The copper alloy material for parts of electronic and electric machinery and tools according to the item (3) or (4), wherein the copper alloy material for parts of electronic and electric machinery and tools is being plated with Sn or a Sn alloy.

(6) The copper alloy material for parts of electronic and electric machinery and tools according to the item (3) or (4), wherein the copper alloy material for parts of electronic and electric machinery and tools is being plated with Sn or a Sn alloy, and is being subjected to a reflow treatment.

(7) The copper alloy material for parts of electronic and electric machinery and tools according to the item (3) or (4), wherein the copper alloy material for parts of electronic and electric machinery and tools is being plated with Cu or a Cu alloy as an underlayer, and is being plated with Sn or a Sn alloy thereon.

(8) The copper alloy material for parts of electronic and electric machinery and tools according to the item (3) or (4), wherein the copper alloy material for parts of electronic and electric machinery and tools is being plated with Cu or a Cu alloy as an underlayer, and is being plated with Sn or a Sn alloy thereon, and is being subjected to a reflow treatment.

(9) The copper alloy material for parts of electronic and electric machinery and tools according to the item (3) or (4), wherein the copper alloy material for parts of electronic and electric machinery and tools is being plated with Ni or a Ni alloy as an underlayer, and is being plated with Au or a Au alloy thereon.

Herein, the present invention means to include both the first and second embodiments, unless otherwise specified.

Further, examples of the preferable copper alloy materials for parts of electronic and electric machinery and tools in the present invention include the followings:

(10) A copper alloy material for parts of electronic and electric machinery and tools, comprising 1.0 to 3.0% by mass (having the same meaning as % by wt) of Ni, 0.2 to 0.7% by mass of Si, 0.01 to 0.2% by mass of Mg, 0.05 to 1.5% by mass of Sn, 0.2 to 1.5% by mass of Zn, and less than 0.005% by mass (including 0% by mass) of S, with the balance being Cu and inevitable impurities, wherein a crystal grain diameter is more than 0.001 mm and 0.025 mm or less; the ratio (a/b), between a longer diameter a of a crystal grain on a cross section parallel to a direction of final plastic working, and a longer diameter b of a crystal grain on a cross section perpendicular to the direction of final plastic working, is 1.5 or less; and wherein a surface roughness Ra after the final plastic working is more than 0 μm and less than 0.1 μm, or a surface roughness Rmax is more than 0 μm and less than 2.0 μm.

(11) A copper alloy material for parts of electronic and electric machinery and tools, comprising 1.0 to 3.0% by mass of Ni, 0.2 to 0.7% by mass of Si, 0.01 to 0.2% by mass of Mg, 0.05 to 1.5% by mass of Sn, 0.2 to 1.5% by mass of Zn, 0.005 to 2.0% by mass in a total amount of at least one selected from the group consisting of Ag, Co and Cr (with the proviso that the Cr content is 0.2% by mass or less), and less than 0.005% by mass (including 0% by mass) of S, with the balance being Cu and inevitable impurities, wherein a crystal grain diameter is more than 0.001 mm and 0.025 mm or less; the ratio (a/b), between a longer diameter a of a crystal grain on a cross section parallel to a direction of final plastic working, and a longer diameter b of a crystal grain on a cross section perpendicular to the direction of final plastic working, is 1.5 or less; and wherein a surface roughness Ra after the final plastic working is more than 0 μm and less than 0.1 μm, or a surface roughness Rmax is more than 0 μm and less than 2.0 μm.

(12) The copper alloy material for parts of electronic and electric machinery and tools according to the item (10) or (11), wherein the copper alloy material for parts of electronic and electric machinery and tools is being plated with Sn or a Sn alloy.

(13) The copper alloy material for parts of electronic and electric machinery and tools according to the item (10) or (11), wherein the copper alloy material for parts of electronic and electric machinery and tools is being plated with Sn or a Sn alloy, and is being subjected to a reflow treatment.

(14) The copper alloy material for parts of electronic and electric machinery and tools according to the item (10) or (11), wherein the copper alloy material for parts of electronic and electric machinery and tools is being plated with Cu or a Cu alloy as an underlayer, and is being plated with Sn or a Sn alloy thereon.

(15) The copper alloy material for parts of electronic and electric machinery and tools according to the item (10) or (11), wherein the copper alloy material for parts of electronic and electric machinery and tools is being plated with Cu or a Cu alloy as an underlayer, and is being plated with Sn or a Sn alloy thereon, and is being subjected to a reflow treatment.

(16) The copper alloy material for parts of electronic and electric machinery and tools according to the item (10) or (11), wherein the copper alloy material for parts of electronic and electric machinery and tools is being plated with Ni or a Ni alloy as an underlayer, and is being plated with Au or a Au alloy thereon.

(17) The copper alloy material for parts of electronic and electric machinery and tools according to any one of the items (1) to (16), which is being subjected to rolling at an angle of 30° or more and 90° or less to the longitudinal direction of a strip to be rolled in a cold-rolling step (this cold-rolling may be the final plastic working) after a heat treatment for forming a solid solution.

BEST MODE FOR CARRYING OUT THE INVENTION

The present invention will be described in detail hereinafter.

The present inventors have intensively studied a Cu—Ni—Si copper alloys, as reported in JP-A-11-222641 ("JP-A" means unexamined published Japanese patent application). We have further studied the copper alloy to improve stress relaxation property, plating characteristics and the like, which are required for enhancement of product reliability especially in the use as a connector which is being much miniaturized in recent years. As a result, we have developed a copper alloy having excellent desired characteristics suitable for the connector material, by employing a specific elements composition as well as by controlling the metallurgical texture (e.g., a crystalline grain size, a crystalline grain shape) and/or the surface states (e.g., a surface roughness (Ra or Rmax)) of the copper alloy.

Each component included in the copper alloy material that can be used in the present invention will be described at first.

Ni and Si as alloy forming elements in the present invention precipitate as a Ni—Si compound in the Cu matrix to maintain required mechanical properties without compromising heat and electric conductivity.

The contents of Ni and Si are defined in the ranges of 1.0 to 3.0% by mass and 0.2 to 0.7% by mass, respectively, because the effect of adding these elements cannot be sufficiently attained when the content of either Ni or Si is less than its lower limit; while when the content of either Ni or Si exceeds its upper limit, giant compounds that do not contribute to the improvement in mechanical strength are recrystallized (precipitated) during casting or hot-working, not only to fail in obtaining a mechanical strength rewarding their contents, but also to cause problems of adversely affecting hot-working property and bending property.

Accordingly, the preferable content of Ni is in the range of 1.7 to 3.0% by mass, more preferably 2.0 to 2.8% by mass, and the preferable content of Si is in the range of 0.4 to 0.7% by mass, more preferably 0.45 to 0.6% by mass. It is best to adjust the blending ratio between Si and Ni to the proportion of them in a $Ni_2Si$ compound, since the compound between Ni and Si mainly comprises the $Ni_2Si$ phase. The optimum amount of Si to be added is determined by determining the amount of Ni to be added.

Mg, Sn and Zn are important alloy elements in the alloy that constitute the copper alloy material of the present invention. These elements in the alloy are correlated with each other to improve the balance among various characteristics.

Mg largely improves stress relaxation property, but it adversely affects bending property. The more the content of Mg is, the more the stress relaxation property is improved, provided that the content is 0.01% by mass or more. However, the content is restricted in the range of 0.01 to 0.2 by mass, because stress relaxation improving effect cannot be sufficiently obtained when the content is less than 0.01 by mass, while, when the content is more than 0.2 by mass, bending property decreases.

Sn is able to more improve stress relaxation property, mutually correlated with Mg. While Sn has a stress relaxation improving effect as seen in phosphor bronze, its effect is not so large as Mg. The content of Sn is restricted in the range of 0.05 to 1.5% by mass, because sufficient effects for adding Sn cannot be sufficiently manifested when the Sn content is less than 0.05% by mass, while, when the Sn content exceeds 1.5% by mass, electric conductivity decreases.

Although Zn does not contribute to the stress relaxation property, it can improve bending property. Therefore, decrease of bending property may be ameliorated by allowing Mg to be contained. When Zn is added in the range of 0.2 to 1.5% by mass, bending property in the practically non-problematic level may be achieved even by adding Mg in maximum 0.2% by mass. In addition, Zn can improve resistance to peeling under heat of a tin plating layer or solder plating layer, as well as anti-migration characteristics. The content of Zn is restricted in the range of 0.2 to 1.5% by mass, because the effect of adding Zn cannot be sufficiently manifested when the Zn content is less than 0.2% by mass, while, when the Zn content exceeds 1.5% by mass, electric conductivity decreases.

In the present invention, the content of Mg is preferably in the range of 0.03 to 0.2% by mass, more preferably 0.05 to 0.15% by mass; the content of Sn is preferably in the range of 0.05 to 1.0% by mass, more preferably 0.1 to 0.5% by mass; and the content of Zn is preferably in the range of 0.2 to 1.0% by mass, more preferably 0.4 to 0.6% by mass.

The content of S as an impurity element is restricted to be less than 0.005% by mass, since hot-working property is worsened by the presence of S. The content of S is particularly preferably less than 0.002% by mass.

In the copper alloy material according to the item (2), (4) or (11), at least one element selected from the group consisting of Ag, Co and Cr is further allowed to contain in the copper alloy material according to the item (1), (3) or (10).

These elements in the alloy described above can contribute to further improvement of the mechanical strength. The total content of these elements in the alloy is in the range of 0.005 to 2.0% by mass, preferably in the range of 0.005 to 0.5% by mass. The total content of the elements in the alloy is defined in the range of 0.005 to 2.0% by mass, because the effect of adding these elements cannot be sufficiently manifested when the content is less than 0.005% by mass. When the content of Ag of exceeding 2.0% by mass, on the other hand, results in a high manufacturing cost of the alloy, while adding Co and Cr of exceeding 2.0% by mass result in recrystallization (precipitation) of giant compounds during casting or hot-working, not only to fail in obtaining a mechanical strength rewarding their contents, but also to cause problems of adversely affecting hot-working property and bending property. The content of Ag is preferably 0.3% by mass or less, since it is an expensive element.

Ag also has an effect for improving heat resistance and for improving bending property by preventing the crystal grains from becoming giant.

Although Co is also expensive, it has the same as or larger function than Ni. Stress relaxation property is also improved since the Co—Si compound is high in hardening ability by precipitation. Accordingly, it is effective to replace a part of Ni with Co in the members in which heat and electric conductivity is emphasized. However, the content of Co is preferably less than 2.0% by mass since it is expensive.

Cr forms fine precipitates in Cu, to contribute to the increased mechanical strength. However, the content of Cr should be 0.2% by mass or less, preferably 0.1% by mass or less, because bending property decreases by adding Cr.

In the present invention, it is possible to add elements, such as Fe, Zr, P, Mn, Ti, V, Pb, Bi and Al, in a total content, for example, of 0.01 to 0.5% by mass for improving various characteristics in an extent not decreasing essential characteristics. For example, hot-working property may be improved by adding Mn in the range that does not decrease electric conductivity (0.01 to 0.5% by mass).

The balance other than the components as described above is Cu and inevitable impurities in the copper alloy material to be used in the present invention.

Although the copper alloy material to be used in the present invention can be manufactured by a usual manner, which is not particularly restrictive, the method comprises, for example, hot-rolling of an ingot, cold-rolling, heat treatment for forming a solid solution, heat treatment for aging, final cold-rolling, and low-temperature annealing. The copper alloy material may be also produced by after cold-rolling, applying a heat treatment for recrystallization and for forming a solid solution, followed by immediate quenching. An aging treatment may be applied, if necessary.

The first embodiment of the present invention will be described hereinafter.

In the first embodiment of the present invention, bending property and stress relaxation property are particularly improved, without compromising essential characteristics such as mechanical property, heat and electric conductivity, and plating property, by allowing the alloy elements in the above copper alloy material such as Ni, Si, Mg, Sn and Zn to contain in appropriate quantities while suppressing the content of S in a trace amount, and by defining the crystal grain diameter and the shape of the crystal grain.

In the first embodiment of the present invention, the crystal grain diameter is defined to be from more than 0.001 mm to 0.025 mm. This is because the recrystallized texture tends to be a mixed grain texture to decrease bending property and stress relaxation property when the crystal grain diameter is 0.001 mm or less, while, when the crystal grain diameter exceeds 0.025 mm, bending property decreases. Herein, the crystal grain diameter may be determined by usual methods for measuring the grain diameter, which is not in particular restrictive. Specifically, the crystalline grain diameter is a value measured according to JIS H 0501 (a cutting method).

The shape of the crystal grain is expressed with the ratio (a/b), between the longer diameter a of the crystal grain on the cross section parallel to the direction of final plastic working, and the longer diameter b of the crystal grain on the cross section perpendicular to the direction of final plastic working. Herein, the term "direction of final plastic working" means the moving direction of a subject (e.g. a sheet, a strip) to be worked in the final plastic working, regardless of an angle formed by this direction and a direction of a roller and the like to work. The ratio (a/b) is defined to be 1.5 or less, because the stress relaxation decreases when the ratio (a/b) exceeds 1.5. The ratio (a/b) is preferably (1/1.5) or more, but 1.5 or less. The stress relaxation tends to be decreased when the ratio (a/b) is less than 0.8. Therefore, the ratio (a/b) is preferably 0.8 or more. The longer diameter a and the longer diameter b each are determined by an average value obtained from 20 or more crystal grains.

With respect to the improvement in stress relaxation property of the alloy of the present invention, it is important to preferably control the crystalline grain shape defined as a ratio (a/b) of the alloy obtained in the present invention. For keeping the stress relaxation property of the alloy high, the crystal grain is most preferably an isotropic shape; i.e. sphere shape is equivalent for diameter in any direction. However, in general, it is clear that a thickness of an individual crystal grain is made thinned down, by working including final plastic working (rolling) when producing materials desired. Then the crystal grain diameter in the rolling direction (MD) is enlarged. The thinned thickness as well as the enlarged diameter depend on a reduction ratio in rolling step. By such a usual working (rolling), a copper alloy material deteriorated in stress relaxation property is obtained. The present inventors have discovered that despite the thickness of grain thinned down, stress relaxation property of the copper alloy can be prevented from deteriorating, or rather be improved, by a specific measure.

In the first embodiment of the present invention, the crystal grain diameter and the shape of the crystal grain can be controlled by adjusting heat-treatment conditions, rolling reduction, direction of rolling, back-tension in rolling, lubrication conditions in rolling, the number of paths in rolling, and the like, in the manufacturing process of the copper alloy.

In the concrete, the crystal grain diameter can be controlled, for example, according to heat treatment conditions, such as a period of time and a temperature in the heat treatment for forming a solid solution or the aging. When a heat treatment is carried out under the heat treatment conditions identical to another heat treatment, the resultant crystal grain diameter depends on working history (e.g., hot-working conditions and cold-working conditions) before the heat-treatment. The crystal grain diameter can be controlled by combining the above conditions properly. Similarly, the shape of crystal grains, i.e. the ratio (a/b), can also be controlled, for example, depending on heat treatment conditions and working conditions (e.g. by carrying out a final plastic working, such as cold-rolling, at a low working amount (a low reduction, at about 0 to 33%), including cold-rolling by skin-pass). In particular, in rolling, the shape of the crystal grain can be controlled as desired, according to not only a one-direction-rolling method but also a cross-rolling method, even if the rolling ratios thereof are identical. According to the cross-rolling method, the shape of the crystal grain (a/b) can be made to 1 or less attaining the purpose of the present invention.

Examples of a method for making the ratio (a/b) to 1 or less, may include a cross-rolling method. For example, one example to carry out cold-working at a reduction of 20%, is a two-step cross cold-rolling method, which is composed of first rolling at a rolling ratio of 10% in one direction (e.g. a longitudinal direction of the strip-shape alloy), and second rolling at a rolling ratio of 10% in another direction (e.g. a direction forming an angle of 30° to 90° (90° is the perpendicular direction) to the first rolling direction). Alternatively, the cold-working at a reduction of 20% can be carried out, by a one-step cold-rolling method at a rolling ratio of 20% in only one direction. By the one-direction rolling method or the cross rolling method, the copper alloys having the ratio (a/b) different from each other can be obtained with a reduction ratio identical to each other. By controlling the ratio (a/b), it is possible to improve both bending property and stress relaxation property.

The direction of final plastic working as used in the present invention refers to the direction of rolling when the rolling is the finally carried out plastic working, or to the direction of drawing when the drawing (linear drawing) is the plastic working finally carried out. The plastic working refers to workings such as rolling and drawing, but working for the purpose of leveling (vertical leveling/stretching) using, for example, a tension leveler, is not included in this plastic working.

The second embodiment of the present invention will be then described.

The second embodiment of the present invention is the copper alloy material for parts of electronic and electric machinery and tools that can be used in the preset invention as described in the above, in which the surface roughness of the alloy is defined so that the surface becomes smooth, particularly property of plating of Sn and the like is improved. The inventors of the present invention have been able to realize practically excellent-materials for the parts of electronic and electric machinery and tools by precisely defining the contents of the components of the alloy material and the surface roughness of the alloy material.

Since the components in the copper alloy material are the same as those in the first embodiment, the reason of restricting the surface roughness will be described hereinafter.

The surface roughness is used as an index representing the surface state of the material.

Ra defined in the second embodiment of the present invention means an arithmetic average of the surface roughness, and is described in JIS B 0601. Rmax denotes the maximum height of roughness, and is described as Ry in JIS B 0601.

The copper alloy material for parts of electronic and electric machinery and tools in the second embodiment of the present invention is manufactured so that the surface of the copper alloy material having the foregoing composition after the final plastic working has the given surface roughness Ra or Rmax (preferably both Ra and Rmax) as described above. The Ra or Rmax, for example, may be adjusted by rolling, grinding, or the like.

The surface roughness of the copper alloy material may be practically adjusted, by (1) rolling with a roll having a controlled surface roughness, (2) grinding after intermediate working and final working, with a buff having a controlled roughness, (3) cutting after intermediate working and final working, by changing cutting conditions, (4) surface dissolution treatment after intermediate working and final working, and a combination thereof. Examples of practical embodiments include cold-rolling as final plastic working with a roll having different roughness (coarse/fine), grinding with a buff having different counts, surface dissolution with a solution having different solubility, and a combination of cold-rolling as a final plastic working with a roll having different roughness and dissolution treatment with a solution having a different dissolution time. Desired surface roughness may be attained by using any one of the methods described above.

It is preferable to plate the copper alloy material for parts of electronic and electric machinery and tools according to the present invention. The plating method is not particularly restricted, and any usual methods may be used. Although not restrictive in the present invention, it is more preferable to plate the copper alloy material for parts of electronic and electric machinery and tools according to the second embodiment, and it is particularly preferable to plate the copper alloy material for parts of electronic and electric machinery and tools described in the item (10) or (11).

Repulsion (cissing, non-uniform plating) may occur when Ra or Rmax is too large in plating with Sn of the copper alloy material for parts of electronic and electric machinery and tools according to the present invention. Too large Ra or Rmax also arise large interface areas between the material and the Sn plating layer, where Cu atoms in the material and Sn atoms in the plating layer are readily diffused with each other. Consequently, Cu—Sn compounds and voids tend to occur to readily result in peeling of the plating layer after maintaining at a high temperature.

Alternatively, pin-holes may occur to deteriorate corrosion resistance after plating with Au of the copper alloy material for parts of electronic and electric machinery and tools according to the present invention, when Ra or Rmax is too large. Accordingly, plating property can be improved by adjusting Ra to be larger than 0 μm and smaller than 0.1 μm, or by adjusting Rmax to be larger than 0 μm and smaller than 2.0 μm. Preferably, Ra is smaller than 0.09 μm or/and Rmax is smaller than 0.8 μm.

It is preferable to plate the surface of the copper alloy material for parts of electronic and electric machinery and tools according to the present invention with Sn or a Sn alloy, in order to prevent color changes in the air. The thickness of the Sn or Sn alloy plating layer is preferably more than 0.1 μm and 10 μm or less. A sufficient plating effect cannot be obtained at a thickness of the plating layer of less than 0.1 μm, while the plating effect is saturated at a thickness of more than 10 μm with increasing the plating cost. Providing a Cu or Cu alloy plating layer under the Sn plating layer is more preferable for preventing repulsion of the plating layer. The preferable thickness of the Cu or Cu alloy plating layer is 1.0 μm or less. The Sn alloy usable includes, for example, Sn—Pb alloys and Sn—Sb—Cu alloys, and the Cu alloy usable includes, for example, Cu—Ag alloys and Cu—Cd alloys.

It is also preferable to apply a reflow treatment, which prevents whiskers as well as short circuits from occuring. The reflow treatment as used herein refers to a heat-melting treatment, by which the plating material is heat-melted followed by solidification of the plate layer after cooling.

It is preferable to plate the surface of the copper alloy material for parts of electronic and electric machinery and tools according to the present invention with Au or an Au alloy for improving reliability of electric connection such as a connector. More preferably, the copper alloy material is plated with Au or an Au alloy at a thickness of larger than 0.01 μm and smaller than 2.0 μm. A Ni or Ni alloy plating layer may be provided under the Au plating layer for improving the plug-in and plug-out service life. The thickness of the Ni or Ni alloy plating layer is preferably 2.0 μm or less. The Au alloy usable includes, for example, Au—Cu alloys, Au—Cu—Ag alloys, and the Ni alloy usable includes, for example, Ni—Cu alloys and Ni—Fe alloys.

Examples of the preferable embodiments in the present invention further include the foregoing item (10) or (11). In these embodiments, the surface roughness defined in the second embodiment is satisfied, while maintaining the crystal grain diameter and crystal grain shape (the ratio (a/b)) defined in the first embodiment. Specific embodiments of these include those in which the first embodiment and the second embodiment are combined.

The copper alloy material for parts of electronic and electric machinery and tools according to the present invention is excellent in mechanical properties (tensile strength and elongation), electric conductivity, stress relaxation property, and bending property.

According to the first embodiment of the present invention as described above, bending property and stress relaxation property are particularly improved while being excellent in essential characteristics such as mechanical properties, electric conductivity and adhesion property of tin plating.

According to the second embodiment of the present invention as described above, further the copper alloy material is also excellent in compatibility to plating (repulsion preventive property of plating), and additional effects such as excellent deterioration preventing property of the plating layer (peeling resistance and corrosion resistance of the plating layer) may also be exhibited when plating.

Accordingly, the present invention can favorably cope with the recent requirements for miniaturization and high performance as well as long life and reliability of performance of the electronic and electric machinery and tools. The present invention is preferably applied to materials for terminals, connectors, switches, relays, and other materials having spring property, leadframes, as well as other general-purpose conductive materials for electronic and electric machinery and tools.

EXAMPLE

The present invention is described in more detail with reference to the following examples, but the present invention is by no means restricted to these examples.

Example A-1

Copper alloys each having a-composition within the range as defined in the present invention, shown in Table 1 (Nos. A to F), were melted in a microwave melting furnace, to cast into ingots with a thickness of 30 mm, a width of 100 mm and a length of 150 mm, by a DC method, respectively. Then, these ingots were heated at 900° C. After holding the ingots at this temperature for 1 hour, they were hot-rolled to a sheet with a thickness of 12 mm, followed by rapid cooling. Then, both end faces of the hot-rolled sheet each were cut (chamfered) by 1.5 mm, to remove oxidation films. The resultant sheets were worked to a thickness of 0.25 to 0.50 mm by cold rolling. The cold-rolled sheets were then heat-treated at a temperature of 750 to 850° C. for 30 seconds, after that, immediately followed by cooling at a cooling rate of 15° C./sec or more. Some samples were subjected to rolling with a reduction of 50% or less. The rolling was carried out, appropriately, with a one-direction rolling method or a cross-rolling method. Then, aging treatment was carried out at 515° C. for 2 hours in an inert gas atmosphere, and cold rolling as a final plastic working was carried out thereafter, to adjust to the final sheet thickness of 0.25 mm. After the final plastic working, the samples were subjected to low-temperature annealing at 350° C. for 2 hours, to carry out evaluation on the following characteristics.

Comparative Example A-1

Copper alloy sheets were manufactured in the same manner as in Example A-1, except that copper alloys (Nos. G to O) out of the composition defined in the present invention, as shown in Table 1, were used.

Each copper alloy sheet manufactured in Example A-1 and Comparative example A-1 was investigated with respect to (1) crystal grain diameter, (2) crystal grain shape, (3) tensile strength and elongation, (4) electric conductivity, (5) bending property, (6) stress relaxation property, and (7) plate adhesion property.

The crystal grain diameter (1) and crystal grain shape (2) were calculated based on the measurement of the crystal grain diameter by a cutting method defined by JIS (JIS H 0501).

As shown in FIG. 1, the cross section A parallel to the direction of the final cold-rolling of the sheet (the direction of the final plastic working), and the cross section B perpendicular to the direction of the final cold-rolling, were used as the cross sections for measuring the crystal grain diameter.

With respect to the cross section A, the crystal grain diameters were measured in two directions that were the direction parallel to or the direction perpendicular to the final cold-rolling direction on the cross section A, and among the measured values, a larger one was referred to as the longer diameter a, and a smaller one was referred to as a shorter diameter, respectively. With respect to the cross section B, the crystal grain diameters were measured in two directions, one of which was the direction parallel to the direction of the normal line of the sheet surface, and the other of which was the direction perpendicular to the direction of the normal line of the sheet surface, and among the measured values, a larger one was referred to as the longer diameter b, and a smaller one was referred to as a shorter diameter, respectively.

The crystalline texture of the copper alloy sheet was photographed with a scanning electron microscope with a 1000-fold magnification, and line segments with a length of 200 mm were drawn on the resultant photograph, and the number n of crystal grains cut with (shorter than) the line segment was counted, to determine the crystal grain diameter, from the following equation: (the crystal grain diameter)={200 mm/(n×1000)}. When the number of crystal grains shorter than the line segment was less than 20, the crystal grains were photographed with a 500-fold magnification, and the number n of crystal grains shorter than the line segment with a length of 200 mm was counted, to determine the crystal grain diameter from the following equation: (the crystal grain diameter)={200 mm/(n×500)}.

The crystal grain diameter is shown by rounding the average value of the four values among the two longer diameters and the two shorter diameters each obtained on the cross sections A and B, to the nearest number that is a product of an integer and 0.005 mm. The shape of the crystal grain is shown as a value (a/b) that is obtained by dividing the longer diameter a on the cross section A by the longer diameter b on the cross section B.

(3) The tensile strength and the elongation were determined in accordance with JIS Z 2241 using #5 test pieces described in JIS Z 2201. The tensile strength is preferably 600 N/mm$^2$ or more.

(4) The electric conductivity was determined in accordance with JIS H 0505. The electric conductivity is preferably 31% or more.

(5) Bending property was evaluated by subjecting each of the sample sheets to a 180° bending test in which the inner bending radius was 0 millimeter, and the sample in which no crack was occurred at the bent portion is judged to be good (○), and the sample in which cracks were occurred is judged to be poor (x).

(6) As an index of the stress relaxation property, was determined the stress relaxation ratio (S.R.R.), by applying a one-side holding block method of Electronics Materials Manufacturers Association of Japan Standard (EMAS-3003), wherein the stress load was set so that the maximum surface stress would be 450 N/mm$^2$, and the resultant test piece was maintained in a constant temperature chamber at 150° C. for 1,000 hours. The stress relaxation property is judged to be good (○) when the stress relaxation ratio (S.R.R.) was less than 21%, and it is judged to be poor (x) when the S.R.R. was 21% or more.

(7) The adhesion property of the plating layer was evaluated in the following manner. A test piece of each of the sample sheets was subjected to glossy tin plating with a thickness of 1 μm, and the resultant test piece was heated at 150° C. for 1,000 hours in the atmospheric air, followed by 180-degree contact bending and bending back. After that, the adhesion state of the tin plating layer at the bent portion was observed with the naked eye. The sample in which no peeling off of the plating layer was recognized is judged to be good in the adhesion property (○), while the sample in which the plate was peeled off is judged to be poor in the adhesion property (x). The results are shown in Table 2.

In all the Examples and Comparative Examples, the surface roughness Ra of each sample was 0.06 μm or more and less than 0.09 μm, and/or the surface roughness Rmax of each sample was 0.6 μm or more and less than 0.8 μm.

TABLE 1

| Class-ification | Alloy No. | Ni wt % | Si wt % | Mg wt % | Sn wt % | Zn wt % | S wt % | Other elements wt % |
|---|---|---|---|---|---|---|---|---|
| Example of this invention | A | 2.0 | 0.49 | 0.09 | 0.19 | 0.49 | 0.002 | |
| | B | 2.5 | 0.60 | 0.08 | 0.20 | 0.49 | 0.002 | |
| | C | 2.0 | 0.48 | 0.04 | 0.20 | 0.50 | 0.002 | |
| | D | 2.0 | 0.49 | 0.04 | 0.82 | 0.49 | 0.002 | |
| | E | 2.0 | 0.48 | 0.08 | 0.21 | 0.49 | 0.002 | Ag 0.03 |
| | F | 2.0 | 0.47 | 0.09 | 0.20 | 0.50 | 0.002 | Cr 0.007 |
| | G | 0.8 | 0.19 | 0.09 | 0.20 | 0.50 | 0.002 | |
| | H | 2.0 | 0.47 | 0.003 | 0.22 | 0.49 | 0.002 | |
| | I | 2.0 | 0.48 | 0.003 | 0.94 | 0.50 | 0.002 | |
| | J | 1.9 | 0.47 | 0.25 | 0.30 | 1.25 | 0.002 | |
| Com-parative example | K | 2.0 | 0.49 | 0.09 | 0.002 | 0.50 | 0.002 | |
| | L | 2.0 | 0.48 | 0.08 | 2.04 | 0.50 | 0.002 | |
| | M | 2.1 | 0.49 | 0.09 | 0.21 | 0.08 | 0.002 | |
| | N | 2.0 | 0.48 | 0.08 | 0.20 | 0.51 | 0.002 | Cr 0.4 |
| | O | 1.9 | 0.46 | 0.09 | 0.33 | 0.49 | 0.011 | |

(Note):
The balance was Cu and inevitable impurities.

As is apparent from the results shown in Table 2, the sample Nos. 1 to 6, which were the examples according to the present invention, each exhibited excellent properties in all the tested items.

Contrary to the above, the prescribed mechanical strength could not be attained in the samples in the comparative example No. 7 since the contents of Ni and Si were too small. The samples of Nos. 8 and 9 were poor in the stress relaxation property due to a too small content of Mg. Further, the sample of No. 9 was poor in electric conductivity. The sample of No. 10 showed poor bending property due to a too large content of Mg. The sample of No. 11 was poor in the stress relaxation property due to a too small content of Sn. Electric conductivity was poor in the sample of No. 12 due to a too large content of Sn. The sample of No. 13 showed poorly low plate adhesion property due to a too small amount of Zn content, while the sample of No. 14 was poor in bending property due to a too large content of Cr. Production of the sample of No. 15 was stopped since cracks occurred during hot-rolling due to a too large content of S.

Example A-2

Copper alloys each having a composition within the range as defined in the present invention, shown in Table 1 (Nos. A to D), were melted in a microwave melting furnace, to cast into ingots with a thickness of 30 mm, a width of 100 mm and a length of 150 mm, by a DC method, respectively. Then, these ingots were heated at 900° C. After holding the ingots at this temperature for 1 hour, they were hot-rolled to a sheet with a thickness of 12 mm, followed by rapid cooling. Then, both end faces of the hot-rolled sheet each were cut (chamfered) by 1.5 mm, to remove oxidation films. The resultant sheets were worked to a thickness of 0.25 to 0.50 mm by cold rolling. The cold-rolled sheets were then heat-treated at a temperature of 750 to 850° C. for 30 seconds, after that, immediately followed by cooling at a cooling rate of 15° C./sec or more. Some samples were subjected to rolling of 50% or less. The rolling was carried out, appropriately, with a one-direction rolling method or a cross-rolling method. Then, aging treatment was carried out

TABLE 2

| Classification | Sample No. | Alloy No. | Crystal grain size mm | Shape of crystal grain | Tensile strength N/mm$^2$ | Elongation % | Electric conductivity %/ACS | Bending property | Stress relaxation property % | Plate adhesion property |
|---|---|---|---|---|---|---|---|---|---|---|
| Example of this invention | 1 | A | 0.005 | 1.1 | 690 | 16 | 40 | ○ | ○15 | ○ |
| | 2 | B | 0.005 | 0.9 | 710 | 15 | 39 | ○ | ○14 | ○ |
| | 3 | C | 0.005 | 1.0 | 685 | 16 | 42 | ○ | ○20 | ○ |
| | 4 | D | 0.005 | 1.1 | 695 | 13 | 32 | ○ | ○17 | ○ |
| | 5 | E | 0.005 | 1.1 | 700 | 16 | 40 | ○ | ○15 | ○ |
| | 6 | F | 0.005 | 1.1 | 700 | 15 | 39 | ○ | ○15 | ○ |
| Comparative example | 7 | G | 0.005 | 1.1 | 520 | 18 | 47 | ○ | ⊗ | ○ |
| | 8 | H | 0.005 | 1.0 | 690 | 16 | 41 | ○ | x29 | ○ |
| | 9 | I | 0.005 | 1.0 | 700 | 16 | 30 | ○ | x26 | ○ |
| | 10 | J | 0.005 | 1.1 | 695 | 15 | 35 | x | ○14 | ○ |
| | 11 | K | 0.005 | 1.1 | 690 | 16 | 44 | ○ | x21 | ○ |
| | 12 | L | 0.005 | 1.0 | 685 | 16 | 24 | ○ | ○15 | ○ |
| | 13 | M | 0.005 | 1.1 | 690 | 16 | 42 | ○ | ○15 | x |
| | 14 | N | 0.005 | 1.0 | 680 | 16 | 38 | x | ○15 | ○ |
| | 15 | O | The production was stopped and not completed due to occurrence of cracks during hot-rolling. | | | | | | | |

(Note) ⊗:
The test was stopped and not completed due to occurrence of plastic deformation at the time to set the sample since the yield value was too low.

at 515° C. for 2 hours in an inert gas atmosphere, and cold rolling as a final plastic working was carried out thereafter, to adjust to the final sheet thickness of 0.25 mm. After the final plastic working, the samples were subjected to low-temperature annealing at 350° C. for 2 hours, thereby manufacturing copper alloy sheets, respectively.

The crystal grain diameter and the shape of the crystal grain of the copper alloy sheets were variously changed within the defined range (the examples according to the present invention) and outside of the defined range (comparative examples), by adjusting heat-treatment conditions, rolling reduction, direction of rolling, back-tension in rolling, the number of paths in rolling, and lubrication conditions in rolling, in the manufacturing process of the copper alloy.

The same items were measured by the same method as in Example A-1 with respect to the copper alloy sheet manufactured as described above. The results are shown in. Table 3.

In all the Examples and Comparative Examples, the surface roughness Ra of each sample was 0.06 μm or more and less than 0.09 μm, and/or the surface roughness Rmax of each sample was 0.6 μm or more and less than 0.8 μm.

TABLE 3

| Clasification | Sample No. | Alloy No. | Crystal grain size mm | Shape of crystal grain | Tensile strength N/mm$^2$ | Elongation % | Electric conductivity %IACS. | Bending property | Stress relaxation property % | Plate adhesion property |
|---|---|---|---|---|---|---|---|---|---|---|
| Example of this invention | 21 | A | 0.005 | 0.9 | 685 | 15 | 40 | ○ | ○15 | ○ |
| | 22 | A | 0.005 | 1.1 | 690 | 16 | 40 | ○ | ○15 | ○ |
| | 23 | A | 0.005 | 1.3 | 705 | 14 | 40 | ○ | ○18 | ○ |
| | 24 | A | 0.005 | 0.7 | 705 | 13 | 40 | ○ | ○20 | ○ |
| | 25 | A | 0.015 | 1.1 | 675 | 16 | 41 | ○ | ○13 | ○ |
| | 26 | B | 0.005 | 0.9 | 710 | 15 | 39 | ○ | ○14 | ○ |
| | 27 | B | 0.005 | 1.2 | 715 | 13 | 39 | ○ | ○17 | ○ |
| | 28 | B | 0.005 | 1.1 | 700 | 14 | 40 | ○ | ○13 | ○ |
| | 29 | C | 0.005 | 1.0 | 685 | 16 | 42 | ○ | ○20 | ○ |
| | 30 | D | 0.005 | 1.1 | 695 | 13 | 32 | ○ | ○17 | ○ |
| Comparative example | 31 | A | 0.005 | 1.7 | 715 | 12 | 40 | ○ | x28 | ○ |
| | 32 | A | 0.005 | 2.0 | 735 | 10 | 42 | x | x37 | ○ |
| | 33 | A | 0.030 | 1.1 | 670 | 9 | 42 | x | ○13 | ○ |
| | 34 | A | 0.001> | 1.0 | 690 | 17 | 40 | x | x21 | ○ |
| | 35 | B | 0.005 | 1.9 | 745 | 10 | 41 | x | x35 | ○ |
| | 36 | B | 0.030 | 1.1 | 700 | 8 | 43 | x | ○13 | ○ |
| | 37 | C | 0.005 | 1.7 | 715 | 12 | 41 | ○ | x34 | ○ |
| | 38 | D | 0.030 | 2.0 | 745 | 6 | 32 | x | x39 | ○ |

(Note)
Nos. 22, 26, 29 and 30 were respectively the same as Nos. 1,2,3 and 4 in Table 1.

As is apparent from Table 3, the samples of Nos. 21 to 30 of the example according to the present invention each exhibited excellent characteristics.

In contrast, bending property was poor in the samples of Nos. 33 and 36, and in the samples of No. 34, because the crystal grain diameters were too large in the former case and too small in the latter case. Not only bending property but also stress relaxation property were poor in the sample of No. 38 since the crystal grain diameter as well as the index (a/b) representing the crystal grain shape were too large. Stress relaxation property was also poor in the samples of Nos. 31, 32, 35 and 37 in the comparative example since the index (a/b) was too large. Bending property was particularly poor in the samples of Nos. 32 and 35 since the index (a/b) was quite too large.

Example B

The alloys having the compositions listed in Table 4, were melted in a microwave melting furnace, to cast into ingots with a dimension of 30 mm×100 mm×150 mm. Then, these ingots were heated at 900° C. After holding the ingots at this temperature for 1 hour, they were hot-rolled from 30 mm to a sheet with a thickness of 12 mm, followed by rapid cooling. Then, both end faces of the hot-rolled sheet each were cut (chamfered) to a thickness of 9 mm, to remove surface oxide films. The resultant sheets were worked to a thickness of 0.27 mm by cold rolling. The cold-rolled sheets were then heat-treated at a temperature of 750 to 850° C. for 30 seconds for recrystallization and for forming solid solutions, after that, immediately followed by quenching at a cooling rate of 15° C./sec or more. Then, cold-rolling with a reduction ratio of 5% was carried out, and aging treatment was carried out. Specifically, the aging treatment was carried out at 515° C. for 2 hours in an inert gas atmosphere. Cold rolling as a final plastic working was carried out thereafter, to adjust to the final sheet thickness of 0.25 mm. After the final plastic working, the samples were then subjected to annealing at 350° C. for 2 hours for improving elasticity. The surface of the copper alloy sheet obtained was ground with a water-proof paper, to finish to the surface roughness, as shown in Table 5. The surface roughnesses Ra and Rmax were measured for each 4 mm interval-length at arbitrary sites of the sample in the direction perpendicular to the direction of rolling, and an average of five times measurements was used as Ra and Rmax. Various characteristics were evaluated with respect to the copper alloy material for parts of electronic and electric machinery and tools obtained as described above.

The tensile strength and elongation, and electric conductivity were measured in accordance with JIS Z 2241 and JIS H 0505, respectively, and the results are listed in Table 5.

A 180° -bending test with an inner bending radius of 0 mm was carried out for the two-step evaluation of bending property, with respect to occurrence of cracks (which means poor in bending property) or absence of cracks (which means good in bending property), as an index of evaluation.

Stress relaxation property was evaluated in accordance with EMA S-3003 as Electronics Materials Manufacturers Association of Japan Standard. The one-side holding block method described in the paragraph [0038] in JP-A-11-222641 was employed in this evaluation, wherein the stress load was set so that the maximum surface stress would be 450 MPa, and the resultant test piece was maintained in a constant temperature chamber at 150° C. The measured values are represented by the stress relaxation ratio (S.R.R) after 1,000 hours' test in Table 5. The stress relaxation property is judged to be poor when the S.R.R. was more than 23% or more.

Apart from the samples used in each of the tests, a sample plated with Sn or Au was manufactured in the following manner, and was subjected to plating characteristics.

The sample above was plated with Sn with a Sn-plating thickness of 1.0 μm on the Cu underlayer plating with a thickness of 0.2 μm. Alternatively, the sample above was plated with Au with a Au-plating thickness of 0.2 μm on the Ni underlayer plating with a thickness of 1.0 μm.

Repulsion of the plating layer was tested by observing the outer appearance of the Sn plated test sample prepared as described above with the naked eye.

In plate-peeling test, the sample plated with Sn was bent at an angle 180°, after heating at 150° C. for 1,000 hours under an atmospheric pressure, and peeling of the plating layer (resistance to peeling under heat of the plating layer), if any, was observed with the naked eye.

As a corrosion resistance test, a salt water spraying test was carried out in an atmosphere of a 5% aqueous NaCl solution, onto the Au-plated sample, at a temperature of 35° C., for 96 hours, and occurrence of corrosion product, if any, was judged with the naked eye. The sample in which no occurrence of corrosion product was recognized was judged to be "good" in the corrosion resistance of plating, while the sample in which the occurrence of corrosion product was recognized was judged to be "poor" in the corrosion resistance of plating.

In all the samples in the Examples and Comparative Examples, the crystalline grain diameter was 0.005 to 0.010 mm, and the crystalline grain shape, the ratio (a/b) was 1.0 to 1.2.

TABLE 4

| | | Content of each component in Copper alloy material* | | | | | | |
|---|---|---|---|---|---|---|---|---|
| | Copper alloy material No. | Ni (mass %) | Si (mass %) | Mg (mass %) | Sn (mass %) | Zn (mass %) | S (mass %) | Other elements (mass %) |
| Example of this invention | 1 | 2.3 | 0.54 | 0.10 | 0.15 | 0.50 | 0.002 | |
| | 2 | 2.8 | 0.67 | 0.08 | 0.70 | 0.40 | 0.001 | |
| | 3 | 2.1 | 0.51 | 0.04 | 0.40 | 1.3 | 0.002 | |
| | 4 | 2.0 | 0.49 | 0.04 | 1.3 | 0.30 | 0.003 | |
| | 5 | 2.3 | 0.55 | 0.99 | 0.21 | 0.87 | 0.002 | Aq 0.05 |
| | 6 | 2.4 | 0.57 | 0.13 | 0.31 | 0.50 | 0.002 | Cr 0.09 |
| | 7 | 1.9 | 0.49 | 0.10 | 0.10 | 0.25 | 0.003 | Co 0.30, Aq 0.03 |
| | 8 | 2.3 | 0.55 | 0.15 | 0.07 | 0.60 | 0.004 | |
| | 9 | 2.5 | 0.60 | 0.08 | 0.60 | 0.36 | 0.002 | Mn 0.21 |
| | 10 | 2.1 | 0.50 | 0.11 | 1.0 | 0.49 | 0.002 | P 0.007 |
| | 11 | 2.3 | 0.54 | 0.06 | 0.16 | 0.77 | 0.001 | Ti 0.08, Al 0.06 |
| | 12 | 2.4 | 0.57 | 0.14 | 0.13 | 1.1 | 0.002 | Cr 0.03, Zr 0.10 |
| | 13 | 2.2 | 0.52 | 0.05 | 0.15 | 0.98 | 0.003 | Ti 0.12, Al 0.09, Fe 0.15 |
| | 14 | 2.3 | 0.54 | 0.18 | 0.19 | 0.48 | 0.002 | Fe 0.12, P 0.007 |
| | 15 | 2.3 | 0.55 | 0.11 | 0.29 | 0.33 | 0.001 | Bi 0.03, Pb 0.02 |
| | 16 | 2.3 | 0.55 | 0.12 | 0.18 | 0.49 | 0.002 | Pb 0.03 |
| | 17 | 2.1 | 0.50 | 0.05 | 0.34 | 0.67 | 0.004 | Ti 0.11, V 0.05 |
| | 18 | 1.2 | 0.29 | 0.17 | 0.85 | 0.40 | 0.002 | |
| | 19 | 1.5 | 0.40 | 0.14 | 0.52 | 0.73 | 0.001 | |
| | 20 | 1.8 | 0.35 | 0.11 | 0.24 | 0.43 | 0.002 | |
| Comparative example | 51 | 0.6 | 0.14 | 0.09 | 0.15 | 0.50 | 0.002 | |
| | 52 | 2.3 | 0.54 | 0.003 | 0.19 | 0.39 | 0.001 | |
| | 53 | 2.2 | 0.52 | 0.003 | 0.94 | 0.60 | 0.002 | |
| | 54 | 2.1 | 0.50 | 0.45 | 0.30 | 1.25 | 0.003 | |
| | 55 | 2.4 | 0.57 | 0.12 | 0.002 | 0.91 | 0.002 | |
| | 56 | 2.3 | 0.54 | 0.05 | 3.04 | 0.44 | 0.004 | |
| | 57 | 2.3 | 0.55 | 0.09 | 0.11 | 0.04 | 0.002 | |
| | 58 | 2.2 | 0.52 | 0.15 | 0.40 | 0.51 | 0.002 | Cr 0.4 |
| | 59 | 2.4 | 0.57 | 0.12 | 0.33 | 0.49 | 0.015 | |
| | 60 | 2.3 | 0.54 | 0.11 | 0.16 | 4.0 | 0.002 | |
| | 61 | 4.7 | 0.49 | 0.06 | 0.19 | 0.56 | 0.002 | |
| | 62 | 2.3 | 1.1 | 0.09 | 0.14 | 0.44 | 0.001 | |
| | 63 | 4.6 | 1.2 | 0.17 | 0.20 | 0.50 | 0.002 | |

(Note)
The balance was Cu and inevitable impurities

TABLE 5

| | Sample No. | Cooper alloy material No. | Surface roughness Ra (μm) | Surface roughness Rmax (μm) | Reflow Treatment of Sn plating | Tensile strength (MPa) | Elongation (%) | Electric conductivity (% IACS) | Bending property (presence or absence of cracks) | Stress relaxation property S.R.R. (%) | Peeling of plate (presence or absence) | Repelling of plate (presence or abscence) | Corrsosion resistance of plate |
|---|---|---|---|---|---|---|---|---|---|---|---|---|---|
| Example of this invention | 101 | 1 | 0.08 | 0.70 | none | 700 | 16 | 40 | absence | 15 | absence | absence | good |
| | 102 | 2 | 0.08 | 0.72 | none | 720 | 14 | 38 | absence | 13 | absence | absence | good |
| | 103 | 3 | 0.08 | 0.71 | none | 695 | 16 | 40 | absence | 20 | absence | absence | good |
| | 104 | 4 | 0.07 | 0.75 | none | 690 | 14 | 35 | absence | 17 | absence | absence | good |
| | 105 | 5 | 0.08 | 0.71 | none | 710 | 14 | 39 | absence | 15 | absence | absence | good |
| | 106 | 6 | 0.07 | 0.69 | none | 710 | 14 | 39 | absence | 14 | absence | absence | good |
| | 107 | 7 | 0.08 | 0.70 | none | 715 | 14 | 41 | absence | 17 | absence | absence | good |
| | 108 | 8 | 0.07 | 0.69 | none | 700 | 16 | 41 | absence | 15 | absence | absence | good |
| | 109 | 9 | 0.08 | 0.70 | none | 715 | 14 | 39 | absence | 14 | absence | absence | good |
| | 110 | 10 | 0.08 | 0.71 | none | 695 | 16 | 39 | absence | 15 | absence | absence | good |
| | 111 | 11 | 0.09 | 0.73 | none | 705 | 16 | 38 | absence | 15 | absence | absence | good |
| | 112 | 12 | 0.08 | 0.70 | none | 710 | 15 | 37 | absence | 15 | absence | absence | good |
| | 113 | 13 | 0.08 | 0.70 | none | 705 | 15 | 37 | absence | 14 | absence | absence | good |
| | 114 | 14 | 0.08 | 0.71 | none | 705 | 15 | 38 | absence | 14 | absence | absence | good |
| | 115 | 15 | 0.07 | 0.68 | none | 705 | 16 | 39 | absence | 15 | absence | absence | good |
| | 116 | 16 | 0.07 | 0.69 | none | 705 | 15 | 39 | absence | 15 | absence | absence | good |
| | 117 | 17 | 0.08 | 0.70 | none | 695 | 16 | 38 | absence | 15 | absence | absence | good |
| | 118 | 18 | 0.08 | 0.70 | none | 600 | 19 | 45 | absence | 20 | absence | absence | good |
| | 119 | 19 | 0.07 | 0.67 | none | 630 | 18 | 40 | absence | 20 | absence | absence | good |
| | 120 | 20 | 0.08 | 0.70 | none | 630 | 18 | 41 | absence | 20 | absence | absence | good |
| | 121 | 1 | 0.04 | 0.51 | none | 700 | 16 | 40 | absence | 15 | absence | absence | good |
| | 122 | 1 | 0.08 | 2.20 | none | 700 | 16 | 40 | absence | 15 | absence | absence | good |
| | 123 | 1 | 0.12 | 1.78 | none | 700 | 16 | 40 | absence | 15 | absence | absence | good |
| | 124 | 1 | 0.09 | 0.75 | done | 700 | 16 | 40 | absence | 15 | absence | absence | good |
| Comparative example | 151 | 51 | 0.08 | 0.70 | none | 490 | 18 | 47 | absence | -(*) | absence | absence | good |
| | 152 | 52 | 0.08 | 0.73 | none | 690 | 16 | 41 | absence | 29 | absence | absence | good |
| | 153 | 53 | 0.08 | 0.71 | none | 700 | 16 | 38 | absence | 26 | absence | absence | good |
| | 154 | 54 | 0.07 | 0.69 | none | 695 | 15 | 35 | presence | 14 | absence | absence | good |
| | 155 | 55 | 0.06 | 0.70 | none | 690 | 16 | 44 | absence | 23 | absence | absence | good |
| | 156 | 56 | 0.07 | 0.72 | none | 685 | 16 | 24 | absence | 15 | absence | absence | good |
| | 157 | 57 | 0.06 | 0.71 | none | 690 | 16 | 42 | absence | 15 | presence | absence | good |
| | 158 | 58 | 0.08 | 0.70 | none | 680 | 16 | 38 | presence | 15 | absence | absence | good |
| | 159 | 59 | — | — | none | The production was stopped and not completed due to occurrence of cracks during hot-working. | | | | | | | |
| | 160 | 60 | 0.07 | 0.78 | none | 700 | 16 | 30 | absence | 15 | absence | absence | good |
| | 161 | 61 | 0.08 | 0.69 | none | 750 | 11 | 36 | presence | 15 | absence | absence | good |
| | 162 | 62 | 0.08 | 0.71 | none | 690 | 14 | 30 | presence | 15 | absence | absence | good |
| | 163 | 63 | — | — | none | The production was stopped and not completed due to occurrence of cracks dunng hot-working. | | | | | | | |
| | 164 | 1 | 0.15 | 2.92 | none | 700 | 16 | 40 | absence | 15 | presence | presence | poor |
| | 165 | 1 | 0.14 | 2.74 | done | 700 | 16 | 40 | absence | 15 | presence | presence | poor |

(Note) (*):
The test was stopped and not Completed due to occurrence of plastic deformation at the time to set the sample since the yield value was too low.

As is evident from Tables 4 and 5, at least one of the characteristics in the samples of the comparative example was poor, contrary to those of each sample in the examples according to the present invention. For example, the sample of comparative example of No. 151 did not exhibit a required mechanical strength due to too small contents of Ni and Si. The samples of No. 152 and No. 153 were poor in stress relaxation property due to a too small content of Mg. The sample of No. 154 showed poor bending property due to a too large content of Mg. The sample of No. 155 showed poor stress relaxation property due to a too small content of Sn. Electric conductivity was poor in the sample of No. 156 due to a too large content of Sn. Plate adhesion property of the Sn plating layer was poor in the sample of No. 157 due to a too small content of Zn, while bending property was poor in the sample of No. 158 due to a too large content of Cr. Production of the sample of No. 159 was stopped since cracks occurred during hot-rolling due to a too large content of S. Electric conductivity was poor in the sample of No. 160 due to a too large content of Zn. Bending property was poor in the sample No. 161 due to a too large content of Ni. Electric conductivity was poor and bending property was poor in the sample of No. 162 due to a too large content of Si. Production of the sample of No. 163 was stopped since cracks occurred during hot-rolling due to too large contents of Ni and Si. Resistance to peeling of the Sn plating layer under heating was poor and the Sn plating layer was repelled in the samples of No. 164 and No. 165 due to too large values of Ra and Rmax. These samples were also poor in corrosion resistance of the Au plating layer.

In contrast, it can be understood that the samples of the examples according to the present invention (No. 101 to No. 124) each exhibited excellent characteristics in all of tensile strength, elongation, electric conductivity, bending property, stress relaxation property and plating characteristics, as compared with the samples in the comparative examples.

Example C

The alloy No. 1 listed in Table 4 was melted in a microwave melting furnace, to cast into an ingot with a dimension of 30 mm×100 mm×150 mm. Then, the ingot was heated to 900° C. After holding the ingot at this temperature for 1 hour, the ingot was hot-rolled from 30 mm to a sheet with a thickness of 12 mm, followed by rapid quenching. Then, both faces each were cut (chamfered) to a thickness of 9 mm, to remove surface oxide films. The resultant sheet was worked to a thickness of 0.25 to 0.50 mm by cold rolling. The cold-rolled sheet was then heat-treated at a temperature of 750 to 850° C. for 30 seconds for recrystallization and for forming a solid solution, after that, immediately followed by quenching at a cooling rate of 15° C./sec or more. Then, aging treatment was carried out at 515° C. for 2 hours in an inert gas atmosphere. Cold rolling as final plastic working was carried out thereafter, to adjust to the final sheet thickness of 0.25 mm. After the final plastic working, the sample was then subjected to low-temperature annealing at 350° C. for 2 hours, thereby manufacturing a copper alloy sheet.

The crystal grain diameter and the shape of crystal grain of the copper alloy sheet were controlled in variously ways within the defined range (the examples according to the present invention) or outside of the defined range (comparative examples), by adjusting heat-treatment conditions, cold-rolling reduction, direction of rolling, back-tension in rolling, the number of paths in rolling, and lubrication conditions in rolling, in the manufacturing process of the copper alloy. The surface roughness of the copper alloy sheet was controlled in variously ways, by grinding the surface of the copper alloy sheet finally obtained or the copper alloy sheet applied aging with a variety of waterproof papers each having a given roughness. Methods for measuring the crystal grain diameter, the shape (the ratio a/b) of the crystal grain, and the surface roughness were the same as those in Examples A and B.

Various characteristics were evaluated with respect to the samples of each copper alloy material for parts of electronic and electric machinery and tools, obtained as described above. Methods for evaluating the characteristics were also the same as those in Examples A and B.

satisfying combined properties at the same time, which are necessary for providing a connector having high reliability, it is important to control not only the alloy elements composition but also each of the crystal grain diameter, the shape of the crystal grain, and the surface roughness of the copper alloy.

Further, as can be understood from Sample No. 166, even when the surface roughness of a copper alloy was so rough after aging, a resulting final surface roughness could be controlled to be within the range defined in the present invention, by final rolling at a larger reduction. However, according to this rolling, the value of ratio (a/b) became too large, and bending property and stress relaxation property were poor.

INDUSTRIAL APPLICABILITY

The copper alloy material for parts of electronic and electric machinery and tools of the present invention is particularly improved in bending property and stress relaxation property while being excellent in essential characteristics such as mechanical property, electric conductivity, and adhesion property of the tin plating layer. Consequently, the copper alloy material of the present invention is able to sufficiently cope with the requirements of miniaturization of parts of electronic and electric machinery and tools such as terminals, connectors, switches and relays. In addition, some embodiments of the copper alloy material for parts of electronic and electric machinery and tools of the present invention can sufficiently match the required plating characteristics. Accordingly, the present invention can preferably cope with recent requirements in miniaturization, high performance, and high reliability, of any types of electronic and electric machinery and tools.

TABLE 6

| | Sample No. | Copper alloy material No. | Crystal grain diameter (mm) | Shape of the crystal grain | Surface roughness Ra (μm) | Surface roughness Rmax (μm) | Reflow treatment of Sn plating | Tensile strength (MPa) | Elongation (%) | Electric Conductivity (% IACS) | Bending property (presence or absence of cracks) | Stress relaxation property S.R.R. (%) | Peeling of plate (presence or absence) | Repelling of plate (presence or absence) | Corrosion resistance of plate (good or poor) |
|---|---|---|---|---|---|---|---|---|---|---|---|---|---|---|---|
| Example of this invention | 101 | 1 | 0.005 | 1.1 | 0.08 | 0.70 | absence | 700 | 16 | 40 | absence | 15 | absence | absence | good |
| Comparative Example | 166 | 1 | 0.005 | 2.0 | 0.06 | 0.61 | absence | 738 | 10 | 42 | presence | 35 | absence | absence | good |
| | 167 | 1 | 0.030 | 1.1 | 0.08 | 0.73 | absence | 685 | 10 | 41 | presence | 14 | absence | absence | good |

As is apparent from Table 6, the surface roughness of the samples Nos. 166 and 167, which were Comparative Examples, were within the range defined in the present invention, but the crystal grain diameter was too large or the ratio (a/b) that was the index of the crystal grain shape was too large. Accordingly the samples were outside the range defined in the present invention. Therefore, although the plating properties were good, the sample No. 166 was poor in both bending property and stress relaxation property and the sample No. 167 was poor in bending property. Accordingly, it was apparent that the samples of Comparative Examples were not suitable for a connector targeted. As mentioned above, in the present invention, for the purpose of Having described our invention as related to the present embodiments, it is our intention that the invention not be limited by any of the details of the description, unless otherwise specified, but rather be construed broadly within its spirit and scope as set out in the accompanying claims.

The invention claimed is:

1. A copper alloy material for parts of electronic and electric machinery and tools, consisting of 1.0 to 3.0% by mass of Ni, 0.2 to 0.7% by mass of Si, 0.01 to 0.2% by mass of Mg, 0.05 to 1.5% by mass of Sn, 0.2 to 1.5% by mass of Zn, less than 0.005% by mass (including 0% by mass) of S, and optionally 0.01 to 0.5% by mass in a total amount of at least one selected from the group consisting of Fe, Zr, P, Mn, Ti, V, Pb, Bi and Al, with the balance being Cu and inevitable impurities, wherein a crystal grain diameter is more than 0.001 mm and 0.025 mm or less; the ratio (a/b), between a longer diameter a of a crystal grain on a cross section parallel to a direction of final plastic working, and a longer diameter b of a crystal grain on a cross section perpendicular to the direction of final plastic working, is 1.5 or less; and wherein a surface roughness Ra after the final plastic working is more than 0 μm and less than 0.1 μm, or a surface roughness Rmax is more than 0 μm and less than 2.0 μm, and wherein the material is excellent in bending property and stress relaxation property.

2. The copper alloy material for parts of electronic and electric machinery and tools according to claim 1, wherein the copper alloy material for parts of electronic and electric machinery and tools is being plated with Sn or a Sn alloy.

3. The copper alloy material for parts of electronic and electric machinery and tools according to claim 1, wherein the copper alloy material for parts of electronic and electric machinery and tools is being plated with Sn or a Sn alloy, and is being subjected to a reflow treatment.

4. The copper alloy material for parts of electronic and electric machinery and tools according to claim 1, wherein the copper alloy material for parts of electronic and electric machinery and tools is being plated with Cu or a Cu alloy as an underlayer, and is being plated with Sn or a Sn alloy thereon.

5. The copper alloy material for parts of electronic and electric machinery and tools according to claim 1, wherein the copper alloy material for parts of electronic and electric machinery and tools is being plated with Cu or a Cu alloy as an underlayer, and is being plated with Sn or a Sn alloy thereon, and is being subjected to a reflow treatment.

6. The copper alloy material for parts of electronic and electric machinery and tools according to claim 1, wherein the copper alloy material for parts of electronic and electric machinery and tools is being plated with Ni or a Ni alloy as an underlayer, and is being plated with Au or a Au alloy thereon.

7. The copper alloy material for parts of electronic and electric machinery and tools according to claim 1, wherein Zn is contained in an amount of 0.2 to 0.6% by mass.

8. The copper alloy material for parts of electronic and electric machinery and tools according to claim 1, which is being subjected to rolling at an angle of 30° or more and 90° or less to the longitudinal direction of a strip to be rolled in a cold-rolling step after a heat treatment for forming a solid solution.

* * * * *